US008240944B2

(12) United States Patent
Chang

(10) Patent No.: US 8,240,944 B2
(45) Date of Patent: Aug. 14, 2012

(54) FIXING DEVICE FOR EMBLEM PLATE

(75) Inventor: Chin-Ming Chang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 302 days.

(21) Appl. No.: 12/637,626

(22) Filed: Dec. 14, 2009

(65) Prior Publication Data

US 2010/0322705 A1 Dec. 23, 2010

(30) Foreign Application Priority Data

Jun. 18, 2009 (CN) ..... 2009 1 0303411

(51) Int. Cl.
*B25G 3/00* (2006.01)

(52) U.S. Cl. ..... 403/348; 403/349; 411/552

(58) Field of Classification Search ..... 403/348, 403/349, 325, 329; 40/1.5, 642.02, 653, 40/654, 662; 411/349, 549, 552; 24/458, 24/453, 581.11
See application file for complete search history.

(56) References Cited

U.S. PATENT DOCUMENTS

| | | | | | |
|---|---|---|---|---|---|
| 1,166,345 | A | * | 12/1915 | Gates | 200/338 |
| 1,494,859 | A | * | 5/1924 | Miller et al. | 279/93 |
| 2,275,073 | A | * | 3/1942 | Buchner | 359/548 |
| 2,279,259 | A | * | 4/1942 | Ballou, Jr. | 24/105 |
| 2,334,680 | A | * | 11/1943 | Murphy | 411/552 |
| 2,833,158 | A | * | 5/1958 | Damon | 74/504 |
| 2,900,697 | A | * | 8/1959 | Cuss | 411/349 |
| 3,137,336 | A | * | 6/1964 | Wing | 411/135 |
| 3,407,454 | A | * | 10/1968 | Myatt | 411/549 |
| 3,816,883 | A | * | 6/1974 | Dzus et al. | 411/349 |
| 4,392,279 | A | * | 7/1983 | Schwager | 24/595.1 |
| 4,640,639 | A | * | 2/1987 | Matsui | 403/24 |
| 4,756,638 | A | * | 7/1988 | Neyret | 403/261 |
| 5,368,427 | A | * | 11/1994 | Pfaffinger | 411/553 |
| 5,445,472 | A | * | 8/1995 | Oukouchi | 403/348 |
| 5,913,605 | A | * | 6/1999 | Jusselin et al. | 37/451 |
| 6,834,838 | B2 | * | 12/2004 | Dennis et al. | 248/311.2 |
| 7,661,215 | B2 | * | 2/2010 | Okamoto | 40/620 |
| 7,849,621 | B2 | * | 12/2010 | Keller et al. | 40/643 |
| 2005/0079011 | A1 | * | 4/2005 | Groff et al. | 403/348 |

FOREIGN PATENT DOCUMENTS

FR 2662755 A1 * 12/1991

* cited by examiner

*Primary Examiner* — Michael P Ferguson
*Assistant Examiner* — Eric Chau
(74) *Attorney, Agent, or Firm* — Altis Law Group, Inc.

(57) ABSTRACT

A fixing device for an emblem plate includes a front cover, a panel, and a rotating member. The emblem plate is located on an outside of the front cover. A locking portion extends from an inner side of the front cover. The locking portion includes a hook. The panel defines a first through hole. The rotating member includes a rotating shaft extending through the first through hole. The rotating shaft axially defines a second through hole. The locking portion extends through the second through hole. A locking block is formed on an inner sidewall of the second through hole, corresponding to the hook. The rotating shaft can be rotated relative to the front cover in the first through hole of the panel, to release the locking block from the hook.

10 Claims, 5 Drawing Sheets

FIXING DEVICE FOR EMBLEM PLATE

BACKGROUND

1. Technical Field

The present disclosure relates to a fixing device for an emblem plate.

2. Description of Related Art

Emblem plates of a computer are usually embedded in a panel of the computer, and generally cannot be removed, and if one of the emblem plates is damaged during production an entire panel of the computer has to be replaced, which is costly.

DETAILED DESCRIPTION

Figure 1:
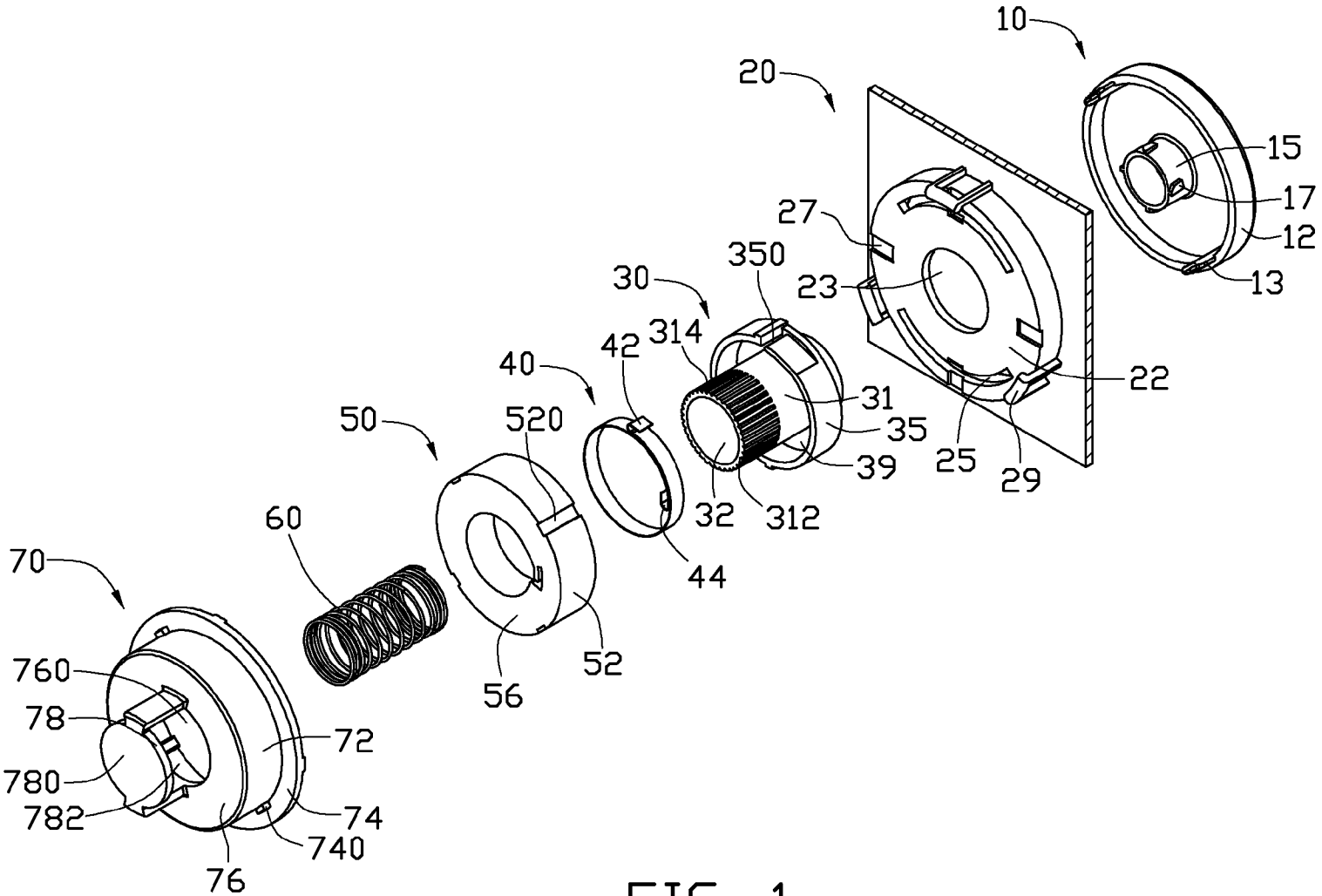
FIG. 1 is an exploded, isometric view of an exemplary embodiment of a fixing device for an emblem plate, the fixing device including a front cover and a rotating shaft.
Figure 2:
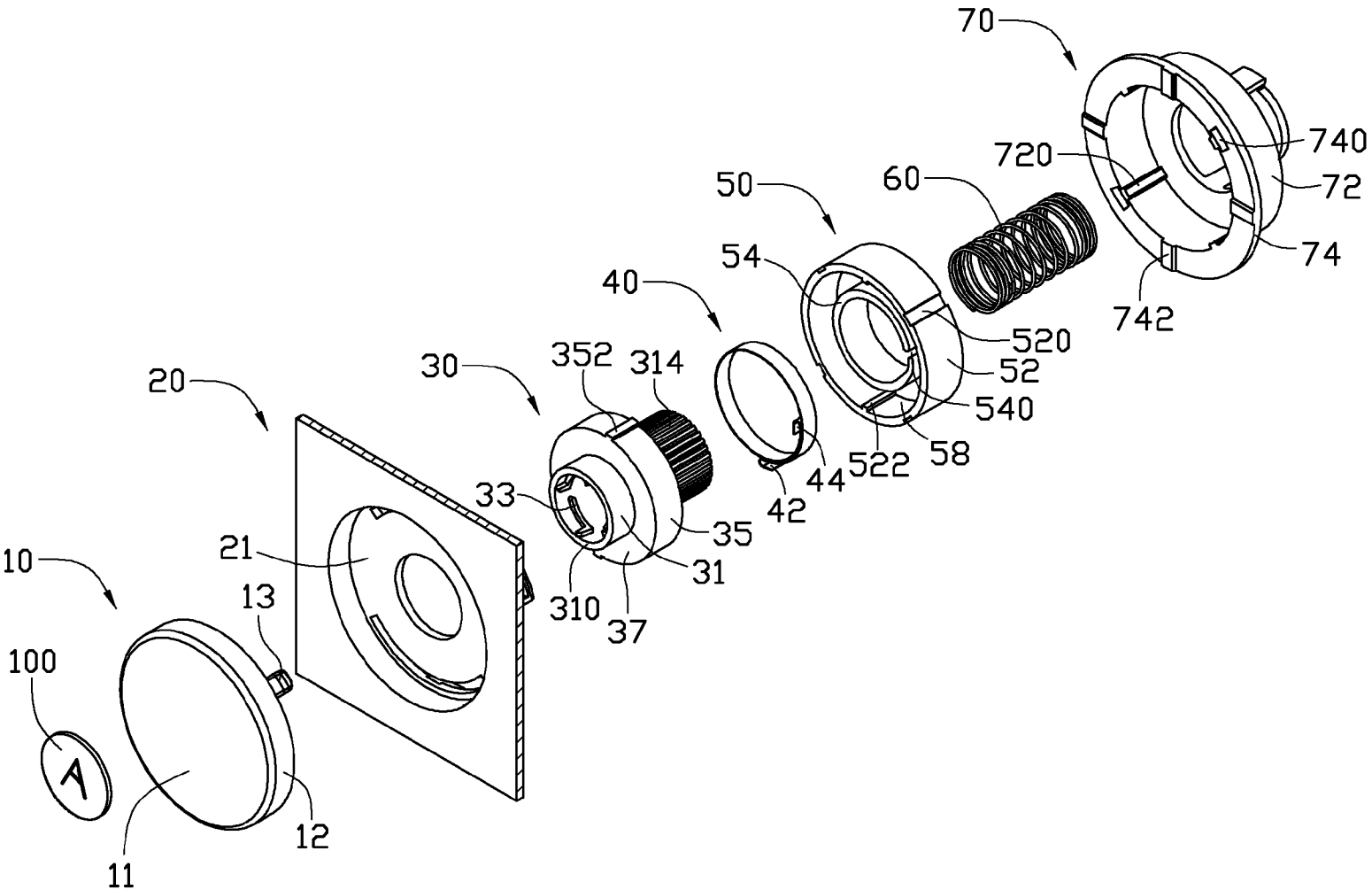
FIG. 2 is a similar to FIG. 1, but viewed from another perspective.
Figure 3:
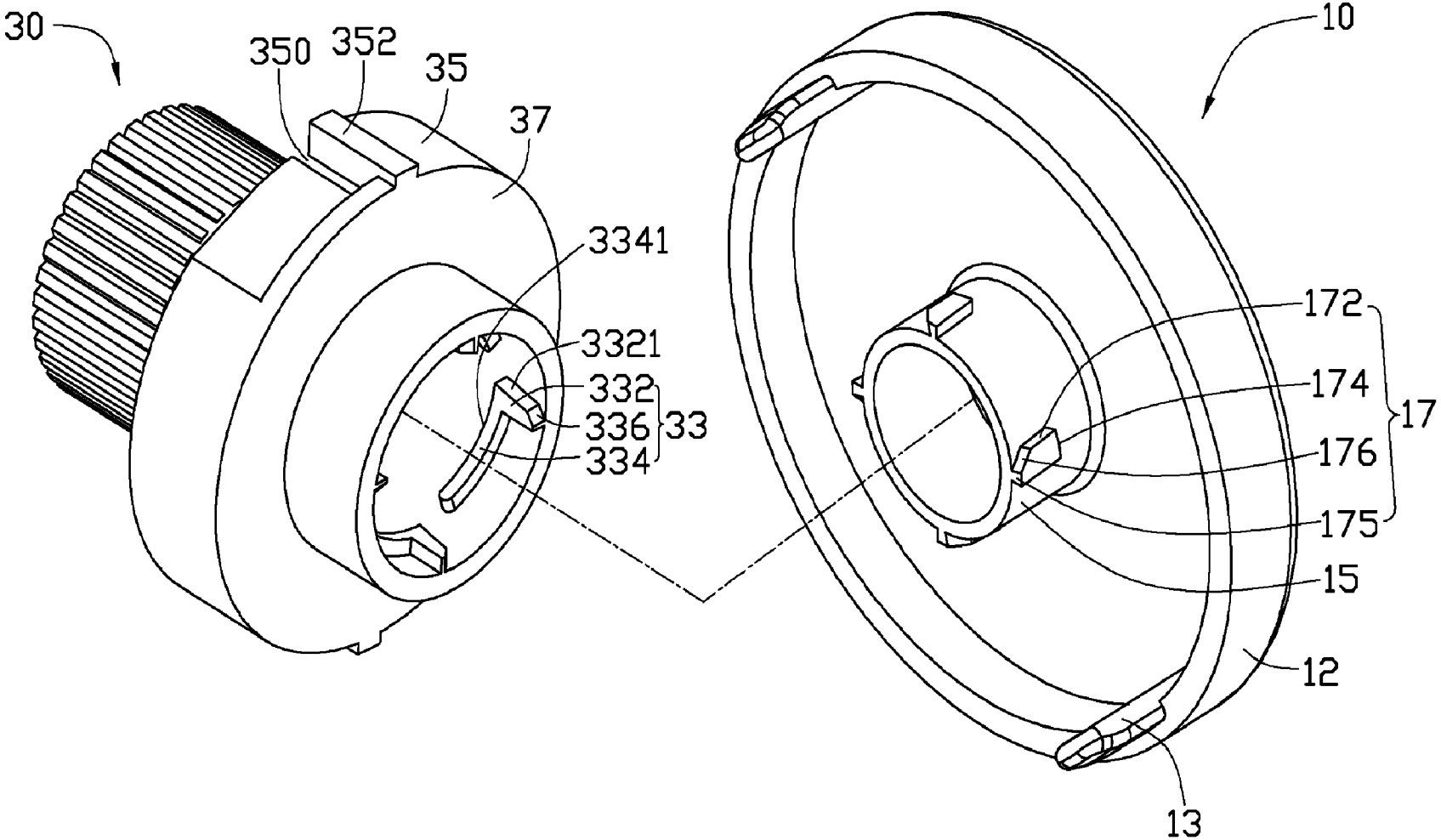
FIG. 3 is an enlarged, isometric view of the front cover and the rotating shaft of the fixing device of FIG. 1.

Referring to FIG. 1 to FIG. 3, an exemplary embodiment of a fixing device for an emblem plate 100 includes a front cover 10, a panel 20, a rotating member 30, a first resilient member 40, a fixing member 50, a second resilient member 60, and a rear cover 70.

The front cover 10 includes a generally round-shaped main body 11, for attaching the emblem plate 100 on a first side of the main body 11. A circular-shaped sleeve 12 perpendicularly extends from a circumference of the main body 11, away from the first side of the main body 11 and surrounding a second side opposite to the first side of the main body 11. Two connecting portions 13 symmetrically extend from an inner surface of the sleeve 12. A hollow column-shaped locking portion 15 perpendicularly extends from a center of the second side of the main body 11. Four hooks 17 project from an outer surface of a circumference of the locking portion 15, evenly arranged on the outer surface of the locking portion 15. Each hook 17 includes a sliding surface 172 parallel to an axis of the locking portion 15, a retaining surface 174 adjacent to the second side of the main body 11 and perpendicularly connected to the sliding surface 172, a stop surface 175 opposite and parallel to the retaining surface 174, and a slanting resisting surface 176 connected between the sliding surface 172 and the stop surface 175. In other embodiments, the number and arrangement of the hooks 17 can be changed according to need.

In one embodiment, the panel 20 is a front panel of a host computer. A column-shaped and depressed receiving portion 21 is defined in a first side of the panel 20 facing the front cover 10. A round through hole 23 is defined in a center of a bottom wall 22 of the receiving portion 21. Two arc-shaped narrow slots 25 are symmetrically defined in a side of the bottom wall 22, and each slot 25 has an angle of $\pi/2$ radians. Four positioning slots 27 are evenly defined in a periphery of an outer surface of the bottom wall 22, opposite to the front cover 10, and two of the positioning slots 27 span two corresponding slots 25, respectively. Three latches 29 evenly extend from an outer surface of a sidewall bounding the receiving portion 21 away from the front cover 10. In other embodiments, the number and arrangement of the latches 29 can be changed according to need.

The rotating member 30 includes a hollow column-shaped rotating shaft 31. The rotating shall 31 includes a first terminal 310 adjacent to the panel 20 and a second terminal 312 opposite to the first terminal 310. A through hole 32 is axially defined in the rotating shaft 31. Four locking blocks 33 protrude from an inner surface of the through hole 32, adjacent to the first terminal 310, in an evenly arrangement. Each locking block 33 includes a sliding portion 332 generally parallel to an axis of the rotating shaft 31, and a resisting portion 334 generally perpendicularly extending from a first end of the sliding portion 332 along a clockwise direction. The first end is more away from the first terminal 310 than an opposite second end. A slanting connecting surface 336 is formed at the second end of the sliding portion 332, away from the resisting portion 334. A sliding surface 3321 is defined on an outer side of the sliding portion 332, to resist the sliding surface 172. A resisting surface 3341 is defined on an underside of the resisting portion 334, to resist the retaining surface 174. A sleeve 35 is set around the rotating shaft 31. A circular-shaped end wall 37 is connected between a circumference of an end of the sleeve 35 and the circumference of the rotating shaft 31, adjacent to the first terminal 310. A ring-shaped slot 39 is bounded by the rotating shaft 31 and the sleeve 35. A groove 350 is defined in the sleeve 35. Two protrusions 352 symmetrically protrude from an outer surface of a circumference of the sleeve 35, and one of the protrusions 352 faces the groove 350. A plurality of skidproof slots 314 is axially defined in an outer surface of the circumference of the rotating shaft 31, adjacent to the second terminal 312, to form an operation portion. The rotating shaft 31 can be rotated by manually rotating the operation portion. In other embodiments, the number and shape of the locking blocks 33 can be designed according to the number and shape of the hooks 17 of the front cover 10.

The first resilient member 40 is a circular-shaped leaf spring. Two generally L-shaped clips 42 and 44 respectively protrude from an outer surface and an inner surface of a circumference of the first resilient member 40. The clips 42 and 44 extend away from each other. The second resilient member 60 is a coil spring.

The fixing member 50 includes a first sleeve 52, a second sleeve 54 surrounded by and coaxial with the first sleeve 52, and a circular-shaped end wall 56 perpendicularly connected corresponding ends of the first and second sleeves 52 and 54. A circular-shaped slot 58 is bounded by the first sleeve 52, the second sleeve 54, and the end wall 56. Four grooves 520 are axially and evenly defined in an outer surface of the first sleeve 52. A latching slot 540 is defined in the second sleeve 54. Two protrusions 522 symmetrically and axially protrude from an inner surface of the first sleeve 52.

The rear cover 70 includes a circular-shaped sleeve 72. A circular-shaped first flange 74 perpendicularly extends out from a circumference of a first end of the sleeve 72. A circular-shaped second flange 76 perpendicularly extends in from a circumference of a second end of the sleeve 72. A round through hole 760 is bounded by the second flange 76. A bracket 78 perpendicularly extends from the second flange 76, straddling the through hole 760, away from the first flange 74. The bracket 78 includes a stop board 780, opposite to the through hole 760. Two openings 782 are symmetrically formed on two opposite sides of the bracket 78, communicating with the through hole 760. A receiving portion is defined between the stop board 780 and the through hole 760. Two connecting holes 740 are defined in the first flange 74, adjacent to the sleeve 72, and corresponding to the two connecting portions 13 of the front cover 10. Four positioning portions 742 protrude from the first flange 74, opposite to the second flange 76, corresponding to the four positioning slots 27 of the panel 20. The connecting holes 740 and the positioning portions 742 are arranged in staggered fashion. Four latching portions 720 protrude from an inner surface of the sleeve 72, corresponding to the four grooves 520 of the fixing member 50.

Figure 4:
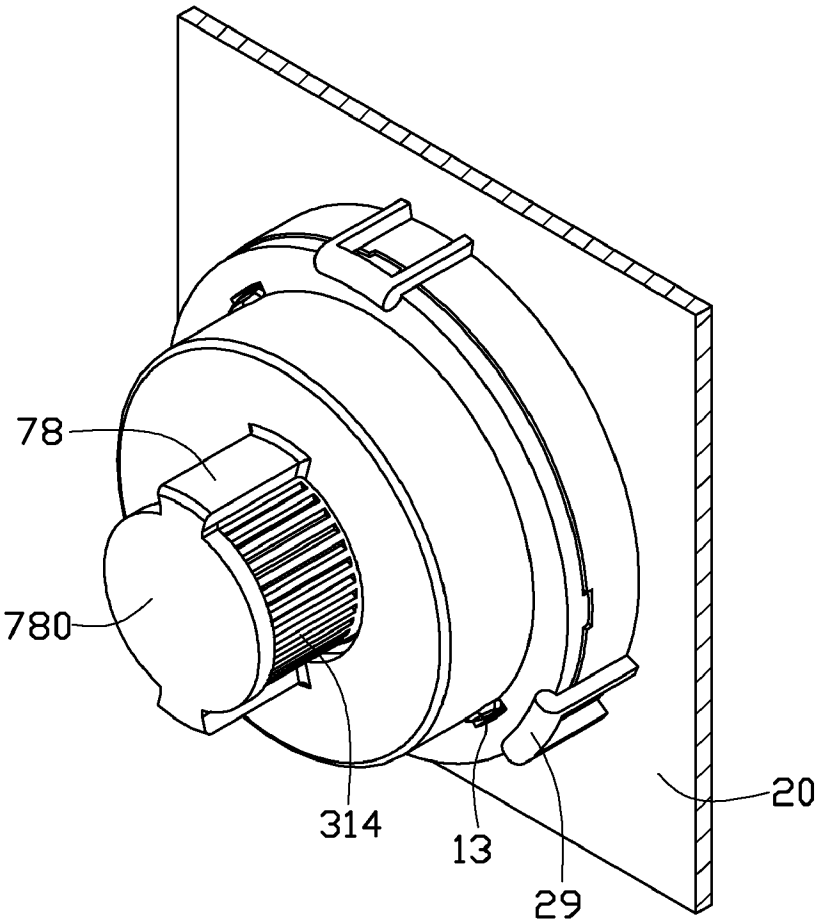
FIG. 4 is an assembled view of the fixing device of FIG. 1.
Figure 5:
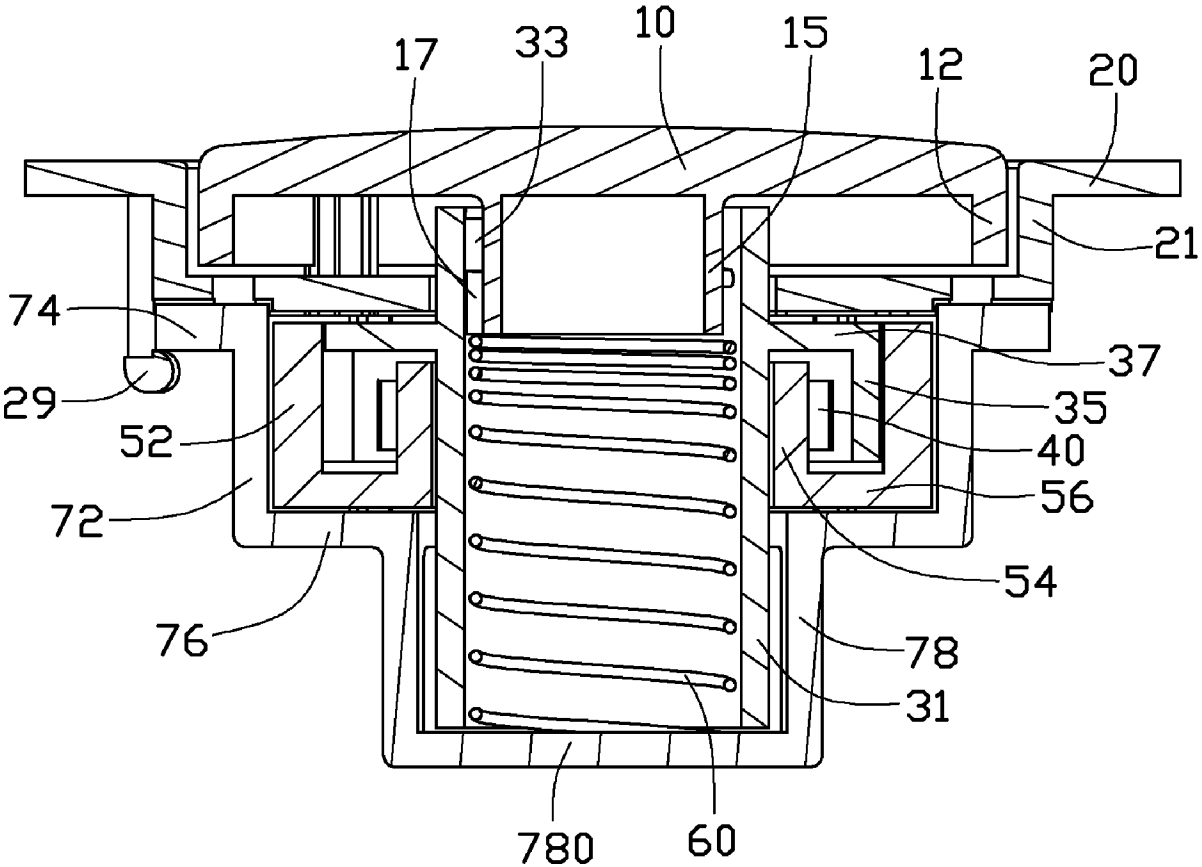
FIG. 5 is a cross-sectional view of FIG. 4.

Referring to FIG. 4 and FIG. 5, in assembly, the first resilient member 40 fits about the second sleeve 54 of the fixing member 50, and is accommodated in the circular-shaped slot 58 of the fixing member 50. The clip 44 is engaged in the latching slot 540 of the second sleeve 54 of the fixing member 50. The rotating shaft 31 of the rotating member 30 extends through the second sleeve 54 of the fixing member 50, with the sleeve 35 of the rotating member 30 received between the first sleeve 52 and the first resilient member 40. The second sleeve 54 and the first resilient member 40 are received in the circular-shaped slot 39 of the rotating member 30. The clip 42 of the first resilient member 40 is engaged in the groove 350 of the sleeve 35. The protrusions 352 of the sleeve 35 may be stopped by the corresponding protrusions 522 of the first sleeve 52 of the fixing member 50. The second resilient member 60 is inserted into the through hole 32 from the second terminal 312 of the rotating shaft 31. The combined assembly of the fixing member 50, the first resilient member 40, the second resilient member 60, and the rotating member 30 are attached to the sleeve 72 of the rear cover 70 from the first flange 74. The end wall 56 of the fixing member 50 resists the second flange 76 of the rear cover 70. A first terminal of the second resilient member 60 resists against the stop board 780. The second terminal 312 of the rotating shaft 31 is received in the receiving portion of the bracket 78. The latching portions 720 engage in the corresponding grooves 520 of the fixing member 50. The first terminal 310 of the rotating shaft 31 extends through the through hole 23 of the panel 20. The end wall 37 of the rotating member 30 resists the outer surface of the bottom wall 22 of the receiving portion 21 of the panel 20. The latches 29 engage with an edge of the first flange 74. The positioning portions 742 of the rear cover 70 are engaged in the corresponding positioning slots 27 of the panel 20. The connecting holes 740 are aligned with the corresponding slots 25 of the panel 20. The sleeve 12 of the front cover 10 is received in the receiving portion 21 of the panel 20. The connecting portions 13 pass through the corresponding slots 25 of the panel 20, to engage in the connecting holes 740 of the rear cover 70. The locking portion 15 is received in the through hole 32 of the rotating member 30. The hooks 17 of the front cover 10 resist the corresponding locking blocks 33 of the rotating member 30.

When the front cover 10 is driven to move towards to the panel 20, the resisting surface 176 of each hook 17 resists the connecting surface 336 of a corresponding locking block 33, to drive the rotating member 30 to rotate a little, thereby deforming the first resilient member 40 by engagement between the clip 42 of the first resilient member 40 and the groove 350 of the rotating member 30. The sliding surface 172 of the hook 17 slides along the sliding surface 3321 of the sliding portion 332 of the locking portion 33, opposite to the resisting portion 334, causing the stop surface 175 of the hook 17 to deform the second resilient member 60. When the retaining surface 174 of the hook 17 moves ahead of the resisting surface 3341 of the resisting portion 334 of the locking block 33, the first resilient member 40 restores to drive the rotating member 30 to return back, causing the retaining surface 174 to resist the resisting surface 3341 of the resisting portion 334. Therefore, the front cover 10 with the emblem plate 100 is fixed to the panel 20.

When the emblem plate 100 needs to be replaced, the operation portion defining the plurality of sliding slots 314 of the rotating member 30 can be accessed through the openings 782 of the bracket 78 of the rear cover 70 and rotated. This action drives the resisting portion 334 of each locking block 33 of the rotating member 30 to move away from the retaining surface 174 of a corresponding hook 17 of the front cover 10. Thus the second resilient member 60 is caused to restore to drive the front cover 10 to move away from the rotating member 30. Therefore, only the front cover 10 with the emblem plate 100 need be replaced, which is convenient and cost effective.

Furthermore, the connecting portions 13 of the front cover 10 can rotate 90 degrees in the corresponding slots 25 of the panel 20, by rotating the rear cover 70 and engagement between the connecting portions 13 and the first flange 74 of the rear cover 70. Therefore, the emblem plate 100 is rotated 90 degrees relative to the panel 20. The fixing device for a emblem plate 100 can replace emblem plates and adjust angles of the emblem plates conveniently.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching. The embodiments were chosen and described in order to explain the principles of the disclosure and their practical application so as to enable others skilled in the art to utilize the disclosure and various embodiments and with various modifications as are suited to the particular use contemplated. Alternately embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. A fixing device for an emblem plate, the fixing device comprising:

a front cover comprising a main body, the main body comprising a first side for the emblem plate being attached thereon, a second side opposite to the first side, a locking portion extending from a second side, and at least one hook extending from the locking portion;

a panel defining a first through hole;

a rotating member comprising a rotating shaft extending through the first through hole of the panel, the rotating shaft axially defining a second through hole, the locking portion detachably received in the second through hole, at least one locking block extending from a sidewall bounding the second through hole and able to engage with the at least one hook;

wherein the rotating shaft is operable to rotate relative to the front cover in the first through hole of the panel, to release the at least one locking block of the rotating member from the at least one hook of the front cover:

a rear cover to receive the rotating member, wherein the main body of the front cover is substantially round-shaped, a first sleeve perpendicularly extends from a circumference of the main body, a depressed receiving portion is defined in the panel, to receive the first sleeve of the front cover, the receiving portion comprises a bottom wall, the first through hole is defined in a center of the bottom wall. wherein the rear cover is fixed to an outer surface of the receiving portion; and a fixing member and a first resilient member, wherein a second sleeve is formed around the rotating shaft, the first resilient member is fixed between the second sleeve of the rotating shaft and the fixing member, to bias the rotating shaft to rotate to a blocking position;

wherein the rear cover comprises a third sleeve, to receive the fixing member, a plurality of latching portions protrudes from an inner surface of the third sleeve, the fixing member comprises a fourth sleeve, a plurality of grooves is defined in an outside of the fourth sleeve, to engage with the plurality of latching portions, the first resilient member is a circular-shaped leaf spring, a first clip and a second clip are respectively formed on an inner surface and an outer surface of the first resilient member, the fixing member further comprises a filth sleeve surrounded by and coaxial with the fourth sleeve, a first slot is defined in the fifth sleeve of the fixing member to engage with the first clip of the first resilient member, and a second slot is defined in the second sleeve of the rotating shaft, to engage with the second clip of the first resilient member.

2. The fixing device of claim 1, wherein each of the at least one locking block comprises a sliding portion extending along an axial direction of the rotating shaft, and a resisting portion generally perpendicularly extending from a first end of the sliding portion, a sliding surface is defined on an outer side of the sliding portion, a resisting surface is defined on an underside of the resisting portion, each of the at least one hook comprises a sliding surface and a retaining surface, the sliding surface is operable to slide along the sliding surface of the sliding portion of the corresponding locking block, and the retaining surface is operable to resist the resisting surface of the resisting portion of the locking block.

3. The fixing device claim 2, wherein a slanting connecting surface is formed on a second end of the sliding portion opposite to the resisting portion, each hook further comprises a slanting resisting surface opposite to the retaining surface, corresponding to the connecting surface, for resisting the connecting surface, to drive the rotating member to rotate.

4. The fixing device of claim 1, wherein a circular-shaped first flange is extended from a circumference of a first terminal of the third sleeve of the rear cover, a plurality of latches is extended from the outer surface of the receiving portion of the panel, to engage with an edge of the first flange of the rear cover.

5. The fixing device claim 4, wherein a plurality of positioning portions is protruded from the first flange, away from the third sleeve of the rear cover, a plurality of positioning slots is defined in the bottom wall of the receiving portion of the panel, to engage with the plurality of positioning portions.

6. The fixing device of claim 5, wherein a pair of connecting holes are defined in the first flange, a pair of arc-shaped slots are defined in the bottom wall of the receiving portion of the panel, a pair of connecting portions are extended from an inner surface of the first sleeve of the front cover, to pass through the corresponding arc-shaped slots and engage in the corresponding connecting holes.

7. The fixing device of claim 6, wherein the radian of each arc-shaped slot of the receiving portion of the panel is $\pi/2$.

8. The fixing device of claim 4, wherein a circular-shaped second flange is extended from a circumference of a second terminal of the third sleeve of the rear cover towards an axis of the third sleeve, a third through hole is defined in a center of the second flange, a bracket is extended from of the second flange around the third through hole, away from the first flange, to receive the rotating shaft, two openings are defined two opposite side of the bracket, to expose the rotating shaft for operating the rotating shaft.

9. The fixing device of claim 8, further comprises a second resilient member, wherein the bracket comprises a stop board opposite to the third through hole, to resist against a first terminal of the second resilient member, a second terminal Of the second resilient member is passed through the second through hole of the rotating shaft, to resist against the locking block of the rotating shaft.

10. The fixing device of claim 9, wherein a plurality of skidproof slots is defined in an outside of the rotating shall, and exposed through the openings of the bracket of the rear cover.

* * * * *